US007164389B1

(12) United States Patent
Platt

(10) Patent No.: US 7,164,389 B1
(45) Date of Patent: Jan. 16, 2007

(54) HIGH FREQUENCY BROADBAND ANTENNA

(75) Inventor: John Jeremy Churchill Platt, Grand Haven, MI (US)

(73) Assignee: R. A. Miller Industries, Inc., Grand Haven, MI (US)

( * ) Notice: Subject to any disclaimer, the term of this patent is extended or adjusted under 35 U.S.C. 154(b) by 117 days.

(21) Appl. No.: 10/711,905

(22) Filed: Oct. 12, 2004

Related U.S. Application Data

(60) Provisional application No. 60/481,534, filed on Oct. 21, 2003.

(51) Int. Cl.
*H01Q 9/04* (2006.01)

(52) U.S. Cl. ..... 343/790; 343/792; 343/793

(58) Field of Classification Search ..... 343/790–793
See application file for complete search history.

(56) References Cited

U.S. PATENT DOCUMENTS

| | | | | |
|---|---|---|---|---|
| 3,680,146 | A * | 7/1972 | Leitner et al. | 343/792 |
| 3,899,787 | A * | 8/1975 | Czerwinski | 343/790 |
| 4,369,449 | A * | 1/1983 | MacDougall | 343/790 |
| 5,506,591 | A * | 4/1996 | Dienes | 343/792 |
| 5,668,564 | A * | 9/1997 | Seward et al. | 343/791 |
| 6,552,692 | B1 * | 4/2003 | Zeilinger et al. | 343/792 |

* cited by examiner

*Primary Examiner*—Tho Phan
(74) *Attorney, Agent, or Firm*—McGarry Bair PC

(57) ABSTRACT

A broadband antenna comprises an upper section with an open sleeve dipole radiator to receive and/or transmit signals in a high frequency band.

7 Claims, 21 Drawing Sheets

HIGH FREQUENCY BROADBAND ANTENNA

CROSS REFERENCE TO RELATED APPLICATIONS

This application claims the benefit of U.S. application Ser. No. 60/481,534 filed Oct. 21, 2003.

FIELD OF THE INVENTION

The invention relates to antennas that can transmit and/or receive in high frequency bands and more particularly to a broadband antenna with an open sleeve dipole radiator.

DESCRIPTION OF THE RELATED ART

It is known to isolate reception on a mobile antenna for vehicles in the 30–88 MHz range by a combination of coaxial cable at a lower end of the antenna and a dipole formed of a linear wire radiator at an upper end of the antenna. The length of such an antenna requires that it be broken down for easy transport. A mating connector at the point where the coaxial cable connects to the wire enables such a break, even though the feed point for the dipole is not at the break. In other words, the break occurs in one of the radiators of the dipole.

A similar structure is also known for NTDR (near term digital radio) antennas in the 225–450 MHz range. One problem has been noted at higher frequencies, however. Conventional point-of-contact connectors between the radiator and the leads from the antenna are not good RF conductors. An improvement for antenna performance at higher frequencies has been found with the use of N or coaxial connectors in place of conventional point-of-contact connectors.

Multiband antennas are known where traps isolate resonance in different frequency ranges, most commonly the AM, FM and CB frequency ranges. But it is also known for antennas with two isolated bands to transmit signals to and from the radiator along two separate leads, one for each band. Sometimes a multiplexer or filter circuit is needed to isolate signals if the separate leads are fed to a common point.

But problems remain in known mobile antennas with connectors between the radiator and the mount, or with connectors between lower and upper ends of an antenna that breaks in a radiator. For example, multiband antennas with three or more frequency ranges may utilize more leads or transmission lines than can reasonably fit within existing connector housings. Higher power antennas generate more heat than can safely be handled by existing connections. Connectors become abraded with repeated twisting of one part relative to another, as for example, the motion that occurs when one connects upper and lower sections of an antenna at a break. Solutions to these problems have heretofore proven illusive.

SUMMARY OF THE INVENTION

According to the invention, an antenna for receiving or transmitting broadband, high frequency signals includes a dipole antenna element encased within a dielectric housing. A conductive sleeve is provided over the dielectric housing at the feed point of the dipole antenna element.

Preferably, the dipole element includes coaxial conductive tubes. If so, the feed point is preferably between the conductive tubes. A dielectric element can be disposed between the conductive sleeve and the dielectric housing.

In another aspect of the invention, the antenna can be incorporated into a multiband antenna. Or it can be incorporated into a mobile antenna for mounting to a vehicle. Whatever the embodiment, the high frequency signals will be within a range of 500–2500 MHz.

DETAILED DESCRIPTION

Figure 1:
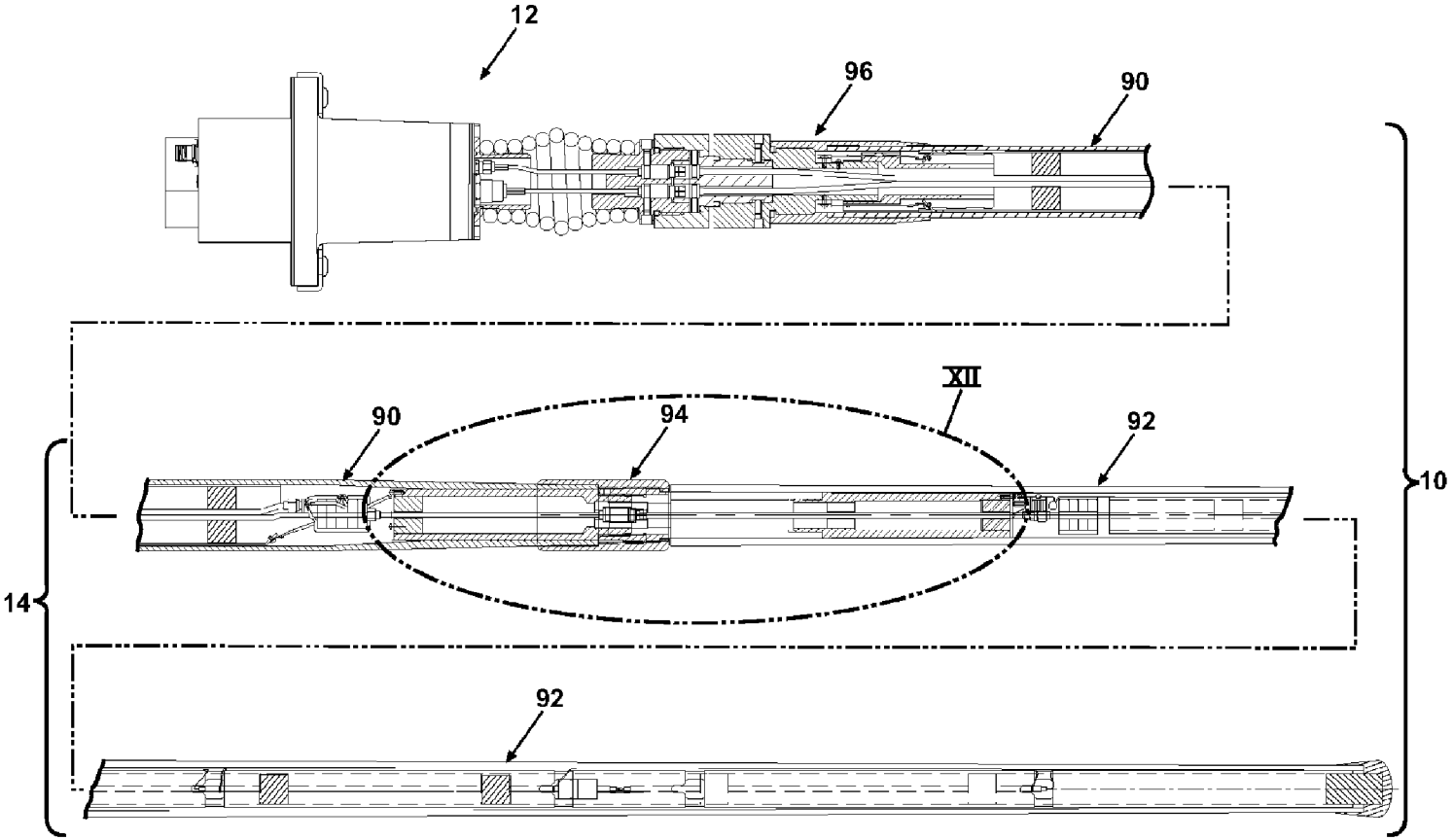
FIG. 1 is a cross sectional view of a first embodiment of a multiband antenna according to the invention.
Figure 2:
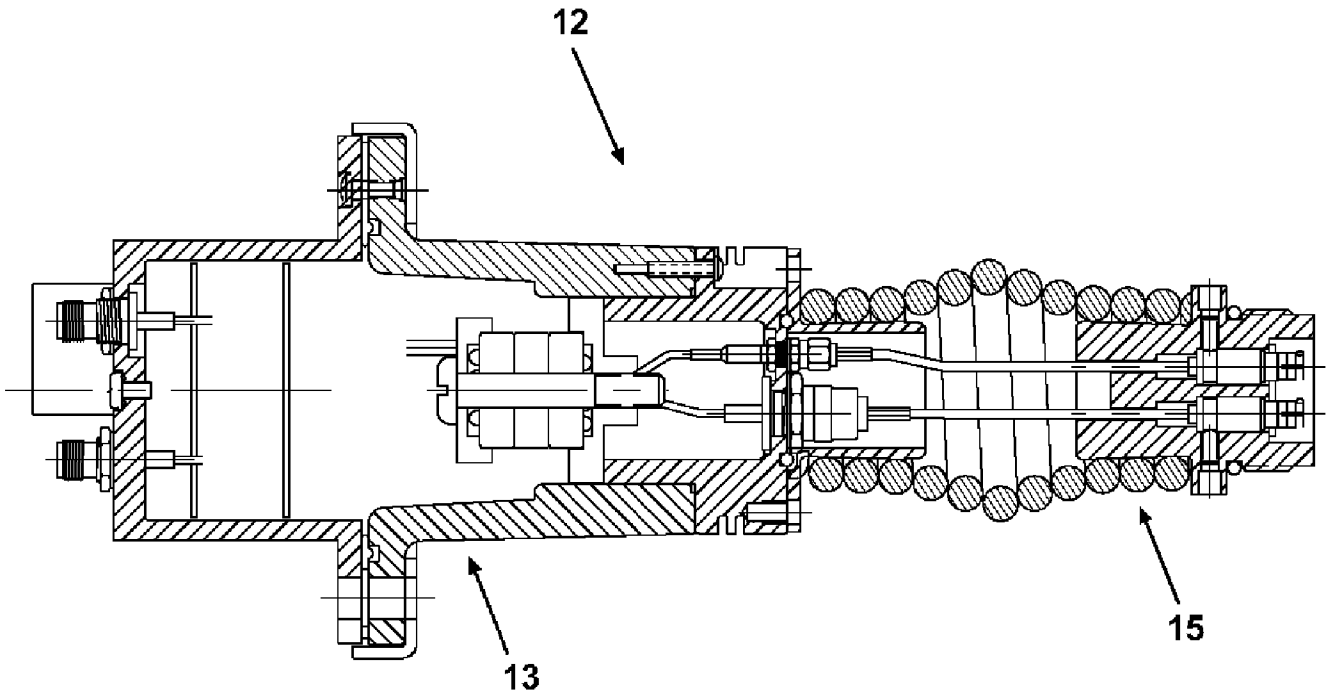
FIG. 2 is a cross sectional view of the mount assembly of FIG. 1.

The invention is illustrated in one or more embodiments of a mobile antenna. Looking first at FIGS. 1–4, a multiband antenna 10 comprises a mount assembly 12 and a whip assembly 14. The mount assembly 12 comprises a base mount subassembly 13 and a spring mount assembly 15. The base mount subassembly 13 comprises a hollow base cover mount 16 with an annular mounting flange 18, and a hollow, generally cylindrical, base support 20, having a matching annular flange 22. The annular flanges 18, 22 are disposed facing each other with a plurality of mounting holes 24 in registry. The base cover mount 16 is secured to the base support 20 by fasteners 25 spaced between the mounting holes 24, and preferably sealed by a gasket 27 or similar seal. The base cover mount 16 and base support 20 thus form an interior chamber 28. A reinforcement ring 26 (also having a plurality of mounting holes 24) is received over the base support 20 with the holes in registry. The mounting holes 24 are all sized so that mounting bolts (not shown) can be utilized to secure the mount assembly 12 to a vehicle.

In this embodiment, two connectors 34, 36 are attached to and extend from the base cover mount 16. Two cable leads 30, 32 extend from the two connectors 34, 36 into the interior chamber 28 to eventually electrically connect to two transmission lines in the whip 14. A base cover 38, preferably made of aluminum or other highly conductive material, has a mount portion 40 and a stepped insert portion 42, which is received in the open end of the base support 20. The base cover 38 is secured to the base support 20 by conventional means. In the illustrated embodiment, the base cover 38 mounts two connectors 44, 46. The exterior of the mount portion 40 has cooling fins to radiate heat that may build up within the chamber 28.

Figure 3:
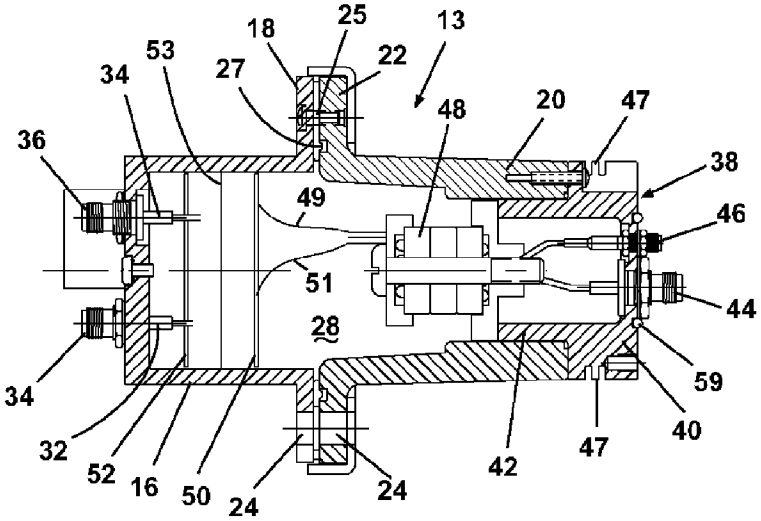
FIG. 3 is a cross sectional view of the base mount subassembly of FIGS. 1 and 2.

Looking now more closely at FIG. 3, it will be seen that the interior chamber 28 houses a cable choke 48 with leads running from the connectors 44, 46. The cable choke 48 is preferably mounted to the base cover 38 and comprises windings on a ferrite core to attenuate undesirable currents from the whip assembly 14. Other acceptable forms for the cable choke 48 may include coiling the leads and mounting ferrite beads over the leads. Also, the ferrite core can be linear or toroidal, as dimensions within the interior chamber 28 permit. Cooling fins 47 on the base cover 38 help dissipate heat generated in the cable choke 48. The interior chamber 28 can also house filters as needed. For example, in this embodiment, leads 49, 51 from the cable choke 48 extend first to a high pass filter 50, and then to a low pass filter 52, separated from each other by an RF shield 53. The two connectors 34, 36 connect to the low pass filter 52 and to the high pass filter 50, respectively, by way of the leads 32, 30.

Figure 4:
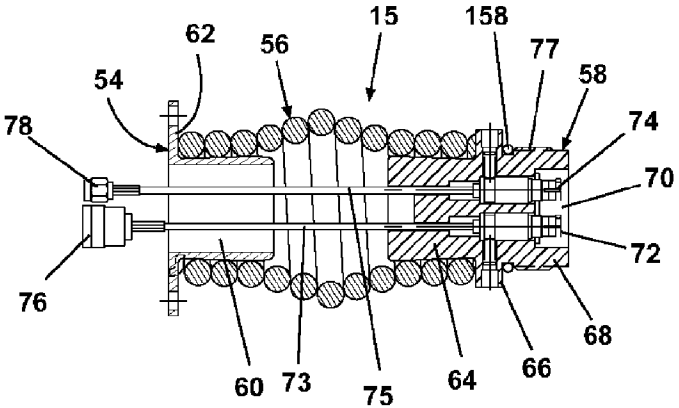
FIG. 4 is a cross sectional view of the spring mount assembly of FIGS. 1 and 2.

Looking now more closely at FIG. 4, the spring mount assembly 15 comprises a lower spring holder 54, a barrel spring 56, and an upper spring holder 58. The lower spring holder 54 comprises a hollow, generally cylindrical, body portion 60 that has an annular flange 62 at one end, centered on the longitudinal axis of the body portion. The annular flange 62 has several apertures at its periphery by which it is securely mounted to the mount portion 40 of the base cover 38. The body portion 60 is secured within a lower end of the barrel spring 56. Importantly, the interior chamber 28, including, preferably, all connections leading to the interior chamber, is sealed against moisture. Thus, for example, a seal 59 can be provided between the annular flange 62 and the body portion 40 of the base cover.

The upper spring holder 58 comprises a lower body portion 64, a hex flange 66, and an upper body portion 68. A recessed cavity 70 is defined in the upper body portion. In this embodiment two male coax connectors 72, 74 are mounted to the upper body portion 68 within the cavity 70. Flexible leads 73, 75 extend, respectively, from the connectors 72, 74 through the lower body portion 64. The leads are long enough to extend through the interior of the barrel spring 56 to connectors 76, 78 that are adapted to connect to the connectors 44, 46, respectively. The leads 73, 75 will accommodate any flexion of the barrel spring 56 while maintaining secure connections at both ends. The upper body portion 68 is externally threaded at 77.

Figure 7:
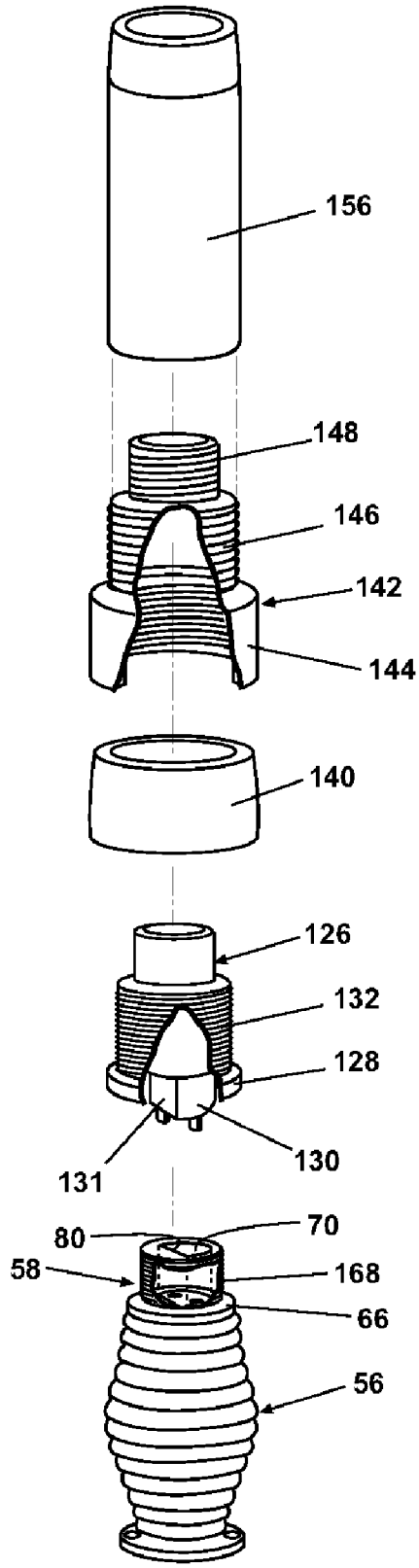
FIG. 7 is an isometric view with parts broken away of the upper spring holder of FIG. 4 and a first embodiment of the coupler assembly of FIG. 5.

Looking now briefly at FIG. 7, a keyway 80 is provided within the cavity 70 in the wall of the upper body portion 68. In this embodiment, the keyway 80 takes the form of a chordal wall, thereby defining, roughly, a "D" shape to the cavity 70. Other forms of keyways are possible, such as a channels or slots.

Turning now again to FIG. 1 and FIGS. 5–10, it will be seen that the whip assembly 14 comprises a lower section assembly 90 and an upper section assembly 92, separable from each other at a junction 94. The lower section assembly 90 comprises at one end a coupler assembly 96 (adapted to connect to the mount assembly 12), an intermediate tubular section 98, and, at the other end, a lower break assembly 100. The intermediate tubular section 98 comprises a dielectric housing 102, preferably fiberglass, into which is nested a conductive sleeve 104, preferably aluminum. Several spaced ribs 106 within the conductive sleeve 104 provide strength and rigidity, and also provide support for two coaxial leads or transmission lines 108, 110, and maintain them centered within the conductive sleeve. If the transmission lines 108, 110 do not remain centered, the performance of the antenna is adversely affected.

Figure 6:
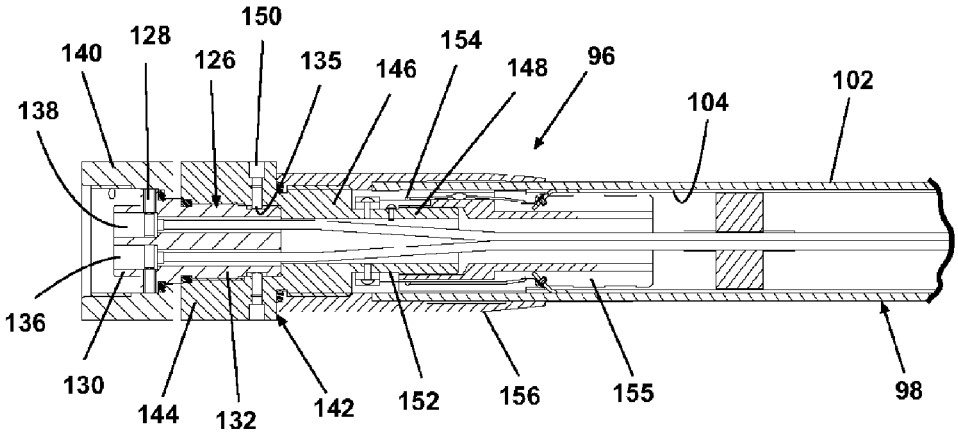
FIG. 6 is an enlarged cross-sectional view of the coupler assembly and the area labeled VI in FIG. 5.

In this embodiment as shown in FIG. 6, the coupler assembly 96 comprises an insert 126 having an annular flange 128 with a keyed extension 130 on one side of the flange, and an externally threaded portion 132 on the other side of the flange. An annular securing channel 135 is located adjacent the threaded portion, away from the annular flange 128. The keyed extension 130 surrounds a pair of female connectors 136, 138, which are positioned to be in registry with and to matingly connect to the male connectors 70, 72. The female connectors 136, 138 are also permanently connected, respectively, to the coaxial leads 108, 110, respectively. Preferably, the keyed extension 130 has a key 131 comprising a flat wall so as to be "D" shaped to nest within the "D" shaped cavity 70.

An internally threaded lock nut 140 is loosely disposed over the annular flange 128 to enclose the keyed extension 130. A conductive hex ferrule 142, having a hex nut 144, an externally threaded portion 146, and an extension 148, is disposed over the insert 126 with the hex nut 144 threaded onto the externally threaded portion 132 of the insert 126. Preferably, the hex ferrule 142 can be further secured to the insert 126 by set screws 150 extending through the hex nut 144 into the securing channel 135. The extension 148 of the hex ferrule 142 preferably has a flat 152 adapted to support a high power impedance matching circuit 154.

A tube reinforcement 155 is fixed within the end of the conductive sleeve 104 and is further secured to the hex ferrule 142. The tube reinforcement 155 not only reinforces the end of the intermediate tubular section 98, but it also provides additional structure to hold the high power impedance matching circuit 154. A conductive coupler 156 surrounds the dielectric lower housing 102, and threads onto the externally threaded portion 146 of the hex ferrule 142.

It can be seen that the coupler assembly 96 mounts to the upper spring holder 58 to secure the whip assembly 14 to the mount assembly 12. This occurs by inserting the keyed extension 130 into the cavity 70. Since it is keyed, it will insert only one way, with the key adjacent the keyway 80. This ensures that the connectors 136, 138 are aligned, respectively, with the connectors 72, 74. As the respective connectors are connected, the lock nut is threaded onto the external thread 77 of the upper body portion 68 until secured tight. Preferably, one or more seals 158 will prevent migration of moisture to the electrical connections within the cavity 70.

The high power impedance matching circuit 154 is needed to maintain an effective balance of current distribution and impedances in the conductive elements of the antenna. In this way, it assists the cable choke 48. This is especially needed where the antenna is broadband, i.e., tuned to optimally receive and/or transmit in a wide frequency range. The high power impedance matching circuit 154 preferably comprises at least one resistor and one capacitor connected in series between the conductive flat 152 of the hex ferrule 142 and the conductive sleeve 104. It may be that in some applications capacitance alone will suffice, which normally improves gain. But in some cases, resistance is needed to obtain matching impedance at a lower end of the desired frequency range. Where resistance is helpful, the resistance and capacitance can be in parallel. In this embodiment, preferably, a high power impedance matching circuit 154 is disposed on opposite sides of the intermediate tubular section 98. A natural consequence of the high power impedance matching circuit 154, especially at high power, is that it generates heat and therefore must dissipate power. When the antenna 10 is used in a high power situation, for example on the order of 300 watts, the mount assembly 12 effectively becomes an integral heat sink. Having a high power impedance matching circuit 154 on opposite sides of the intermediate tubular section 98 assists in dissipating heat around the mount assembly 12, and enables smaller, less costly components to handle the currents at higher powers. As well, the conductive coupler 156 not only strengthens the bottom of the whip assembly 14, but it adds capacitance to affect current distribution, and it increases the area serving as a heat sink.

Figure 5:
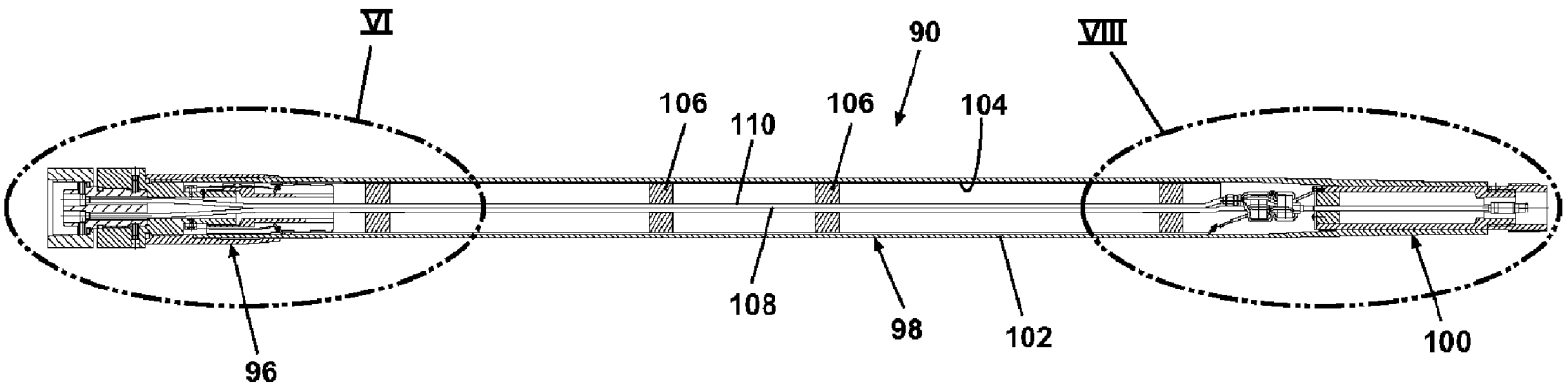
FIG. 5 is a cross sectional view of the lower section assembly of the whip assembly according to the invention.
Figure 8:
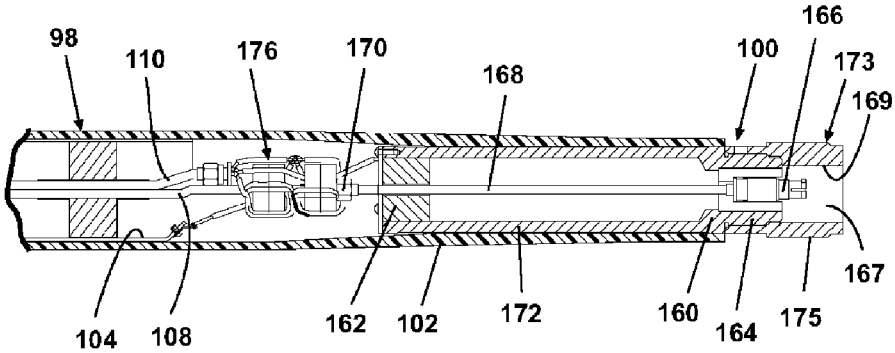
FIG. 8 is an enlarged cross-sectional view of the lower break assembly and the area labeled VIII in FIG. 5.

As shown more clearly in FIGS. 5 and 8, the lower break assembly 100 is disposed at the end of the intermediate tubular section 98 away from the coupler assembly 96. It comprises a conductive cylinder 160, preferably aluminum, with a cable sleeve 162 closing one end and a connector mount 164 near the other end. The connector mount 164 is externally threaded and supports a male connector 166 that is electrically connected to a break cable 168 that runs from the connector 166 through the cable sleeve 162 to a male coax connector 170. The exterior wall 172 of the conductive cylinder 160 is preferably knurled and dimensioned to be press fit within the dielectric lower housing 102, with the connector mount 164 protruding therefrom. An adapter 173, having an external threaded portion 175 roughly the same diameter as the dielectric lower housing 102 can be mounted to the connector mount 164. The adapter 173 defines a cavity 167 at the end of the connector mount 164, in which the male connector 166 is disposed. An interior wall of the adapter 173 has a keyway 169, preferably a chordal wall similar to the structure in the coupler assembly 96.

The conductive sleeve 104 in the intermediate tubular section 98 terminates at a point spaced from the lower break assembly 100. The two coaxial leads 108, 110 extend beyond the end of the conductive sleeve 104. The lead 108 has a female coax connector (not shown in FIG. 8) that mates directly with the male coax connector 170 on the break cable 168. The other lead 110 connects to a line transformer such as balun 176. The balun 176, in turn, connects to the conductive sleeve 104 and to the conductive cylinder 160 of the lower break assembly 100 and can act within a given frequency range as a feed point 178. In this embodiment, it functions as the center feed point 178 of the dipole radiator for the lower frequency band of 30–88 MHz.

Turning now to the upper section assembly 92, shown best in FIGS. 9–17, it can be seen that the upper section assembly 92 comprises an upper break assembly 180 and a top section 182. As shown more closely in FIG. 10, the upper break assembly 180 comprises a conductive cylinder 184, preferably aluminum, with a cable sleeve 186 at one end and a connector mount 188 at the other end. The connector mount 188 supports a female connector 192 that is electrically connected to a break cable 194 that runs from the female connector 192 through the cable sleeve 186 to a male coax connector 196. The connector mount 188 has a key 189 that is preferably a chordal surface on the mount so it has a "D" shape, complementary in size to be received within the cavity 167 in the lower break assembly 100.

The conductive cylinder 184 at the connector mount 188 has an external flange 190. A lock nut 200, having an internal annular shoulder 202 at one end and an internal thread 204 intermediate the annular shoulder 202 and the other end, slides over the conductive cylinder 184 until the internal shoulder 202 bears against the external flange 190. The exterior wall 206 of the conductive cylinder 184 is preferably knurled and dimensioned to be press fit within a dielectric upper housing 208.

The junction 94 in the whip assembly 14 is provided when the lower break assembly 100 is attached to the upper break assembly 180. This occurs simply and easily by inserting the connector mount 188 into the cavity 167 with the key 189 bearing against the keyway 169, mating the male connector 166 on the upper break assembly 180 to the female connector 192 of the lower break assembly 100, and then threading the internal threads 204 of the lock nut 200 of the upper break assembly 180 onto the external threaded portion 175 of the adapter 173 on the lower break assembly 100. The resultant junction 94 of the combined lower break assembly 100 and upper break assembly 180 is not only strong, but effectively becomes one pole of a dipole radiator. The conductive sleeve 104 and conductive cylinder 184 are electrically connected via the balun 176 and function together as an electrical radiator, fed by the coaxial transmission line 110. Preferably, the length of the junction 94 is sufficient to provide a portion of a dipole in a predetermined frequency band. For an application in the range of 108–175 MHz, the length can be about 19 inches. If necessary to achieve this length, one or more extensions 191 of the conductive portions can be provided at either the lower break assembly 100 and/or, as shown in FIG. 9, at the upper break assembly 180.

Figure 9:
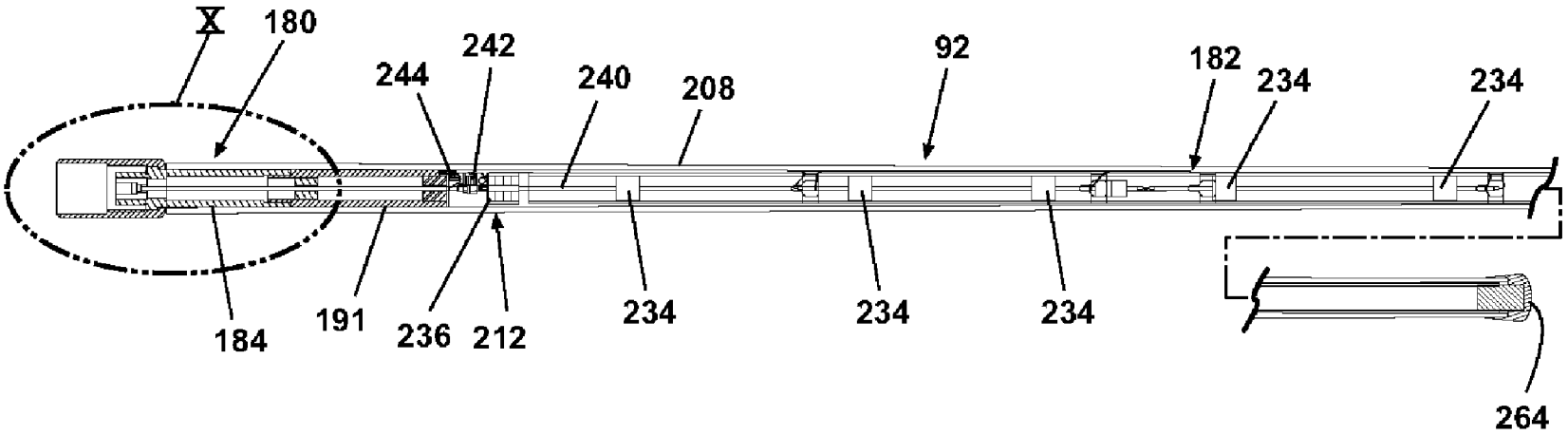
FIG. 9 is a cross sectional view of the upper section assembly according to the invention.
Figure 10:
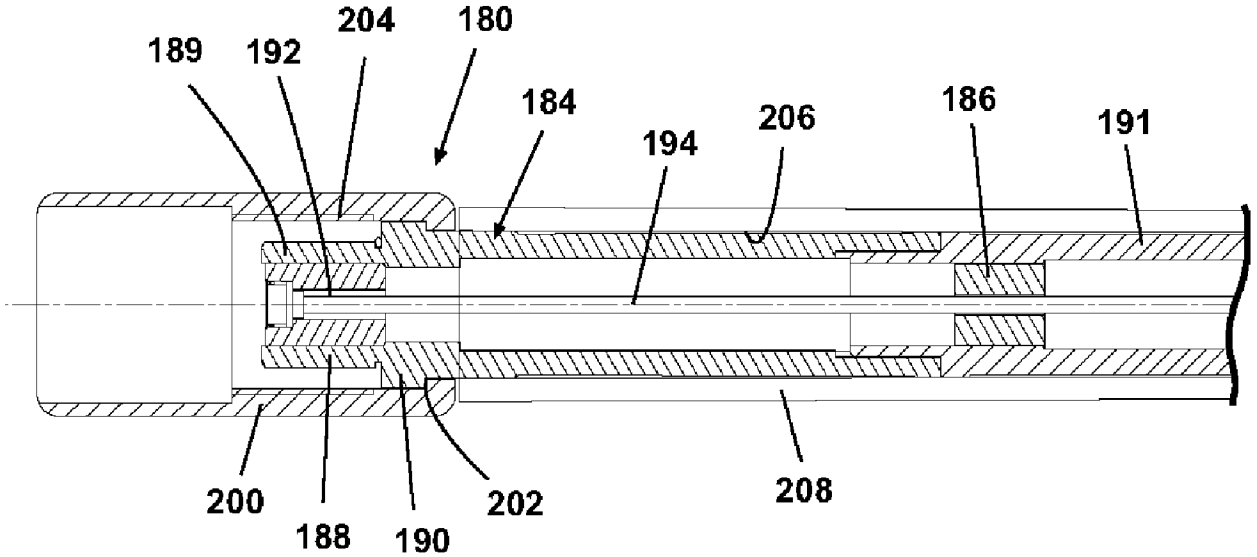
FIG. 10 is an enlarged cross sectional view of the upper break assembly and the area labeled X in FIG. 9.
Figure 11:
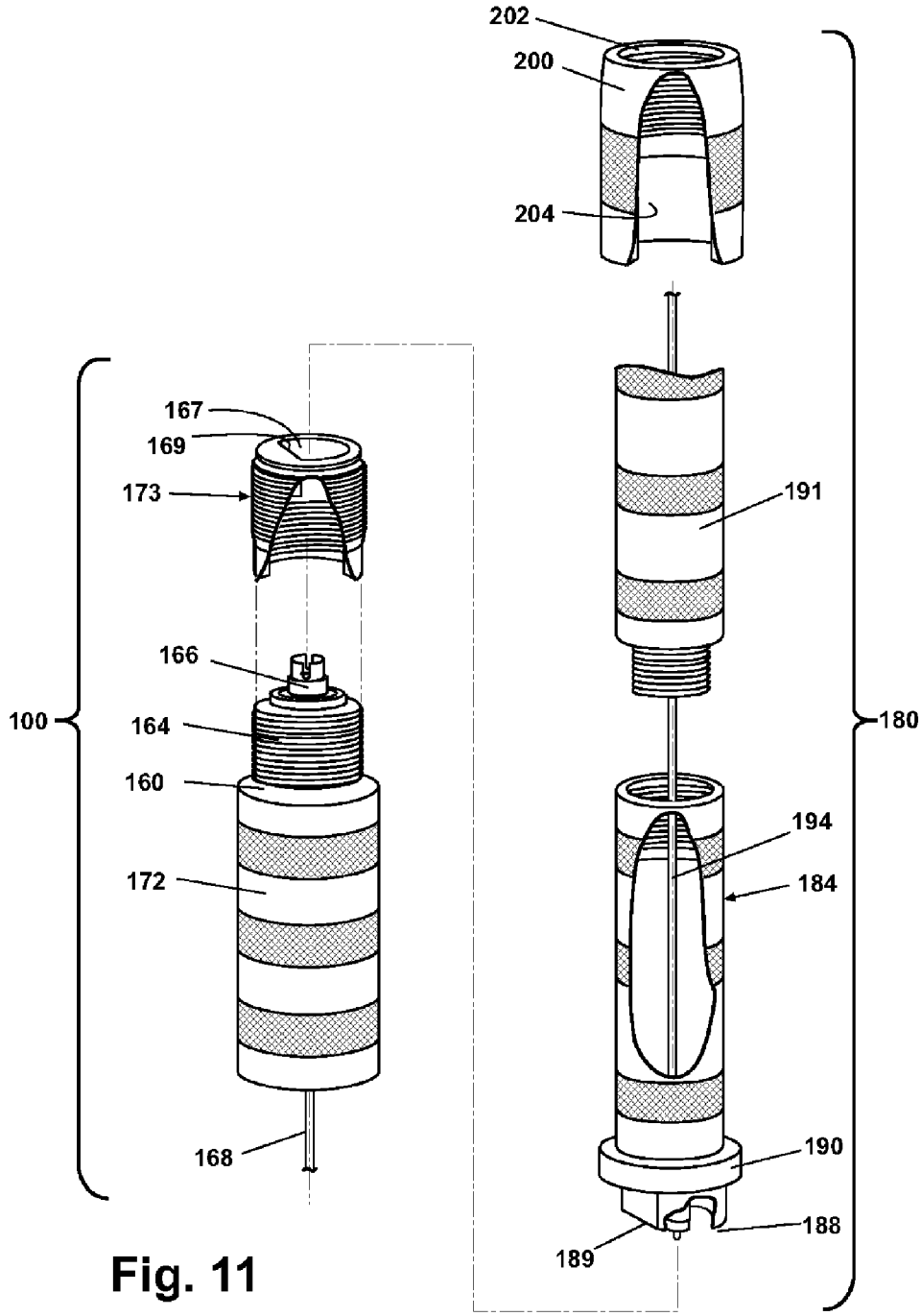
FIG. 11 is an isometric view with parts broken away of the lower break assembly of FIG. 8 and a first embodiment of the upper break assembly of FIG. 10.
Figure 12:
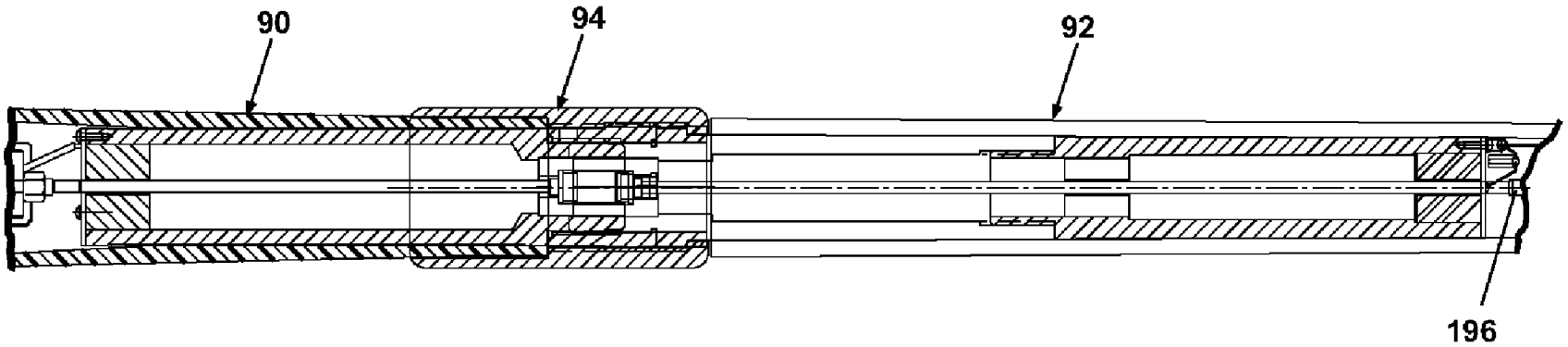
FIG. 12 is an enlarged cross section view of the junction and the area labeled XII in FIG. 1.
Figure 13:
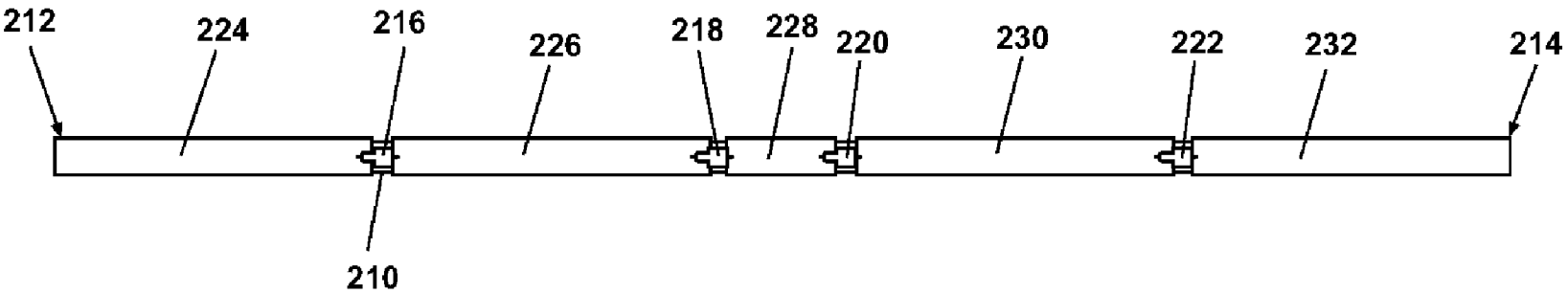
FIG. 13 is an elevational view of the upper element tube with conductive sleeves in the upper section assembly of FIG. 9

Looking now at FIGS. 9 and 13, the top section 182 comprises the dielectric upper housing 208 that completely encloses a non-conductive upper element tube 210 having a proximal end 212, a distal end 214, and a plurality of slots, preferably four, 216, 218, 220, and 222 spaced from each other intermediate the proximal and distal ends. Conductive sleeves 224, 226, 228, 230, and 232, spaced from each other, are provided between the slots, as well as between the slots and the proximal and distal ends. The conductive sleeves can be metal foil, preferably wrapped around the upper element tube 210. Interior of the upper element tube 210 are a plurality of cable sleeves 234 adapted to support one or more cables extending through the interior of the upper element tube and maintain them centered within the tube.

Looking now also at FIGS. 14–17, a first cable 240, supported by cable sleeves 234, extends out of the proximal end 212 to a connector 242. A ferrite toroid 236 surrounds the first cable 240 between the connector 242 and the proximal end 212, and functions as a cable choke. The connector 242 connects to the connector 196 of the upper break assembly 92. A lead 244 runs from the first cable 240 to the conductive cylinder 184 (or extension 191 as the case may be) and to the conductive sleeve 224 where it can function as a feed point 245 in a given frequency range. The first cable 240 preferably has a rated impedance of 50 Ohms.

The first cable 240 extends in the other direction to a feed point 246 where it connects to a second cable 248 and a third cable 250. The second and third cables 248, 250 are preferably identical in impedance and length, each having a rated impedance of 93 Ohms. The second cable 248 extends to the fourth slot 222 where it is electrically connected to the fourth 230 and fifth 232 conductive sleeves at a 1$^{st}$ dipole feed point 252. The third cable 250 extends back parallel with the first cable 240 to the first slot 216 where it is electrically connected to the first 224 and second 226 conductive sleeves at a 2nd dipole feed point 254.

Figure 14:
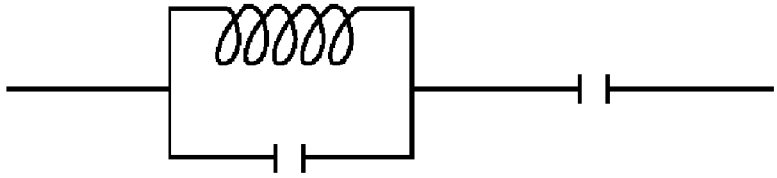
FIG. 14 is a schematic view of an isolation circuit according to the invention.

An isolation circuit 256 is provided at slot 216, electrically connected between conductive sleeve 224 and conductive sleeve 226. Another isolation circuit 258 is provided at slot 218, electrically connected between conductive sleeve 226 and conductive sleeve 228. Another isolation circuit 260 is provided at slot 220, electrically connected between conductive sleeve 228 and conductive sleeve 230. And yet another isolation circuit 262 is provided at slot 222, electrically connected between conductive sleeve 230 and conductive sleeve 232. Each isolation circuit 256, 258, 260, and 262 is preferably an LC parallel circuit with series capacitor, as shown in FIG. 14. Each isolation circuit 256, 258, 260, and 262 functions to isolate a higher frequency band from a lower frequency band, with the values of inductance and capacitance being selected for the midrange of a given frequency band. An end cap 264 is provided at the end of the dielectric upper housing 208 to enclose the interior and protect it from atmospheric elements.

Figure 15:
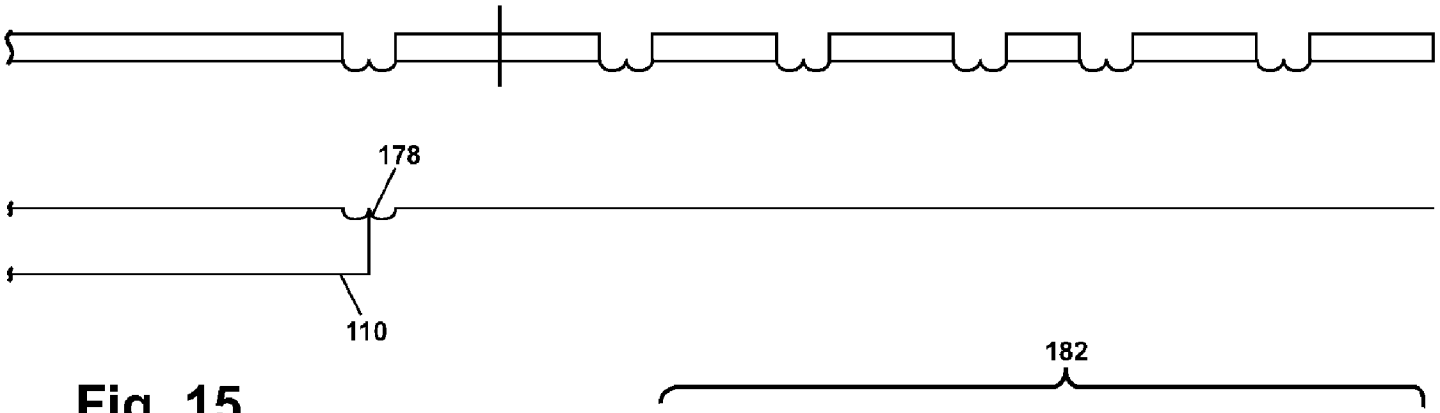
FIG. 15 is a schematic and electrical view of the dipole for the first band.
Figure 16:
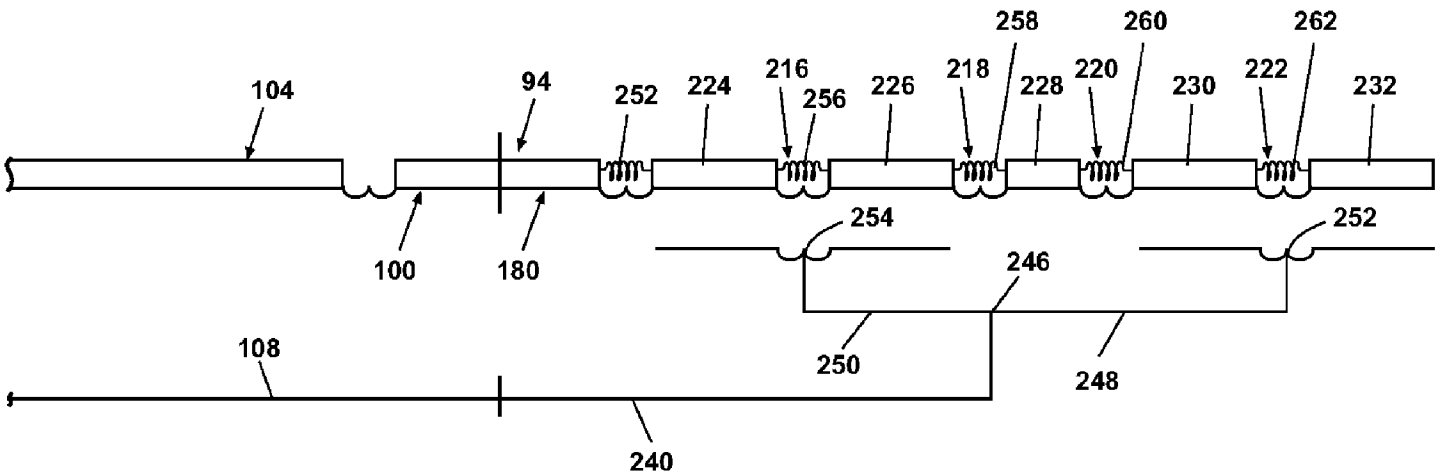
FIG. 16 is a schematic and electrical view of the dipoles for the third band.

It will be apparent that the foregoing structure provides a multiband antenna with multiple dipoles, capable of effectively receiving at least three frequency bands. Say, for example, one wanted to receive or transmit signals in a first band of 30–88 MHz, a second band of 108–175 MHz, and a third band of 225–450 MHz. The relatively low frequency first band is resonant in the dipole radiator defined by the conductive sleeve 104 on the one hand, and the dipole connector 94 and top section 182, with the feed point for the first band being the feed point 178, all as shown in FIG. 15. The relatively high frequency third band is resonant in the stacked dual dipoles of the top section 182, the 1$^{st}$ dipole comprising conductive sleeves 230 and 232 with feed point 252, and the 2$^{nd}$ dipole comprising conductive sleeves 224 and 226 with feed point 254, all as shown in FIG. 16.

Figure 17A:
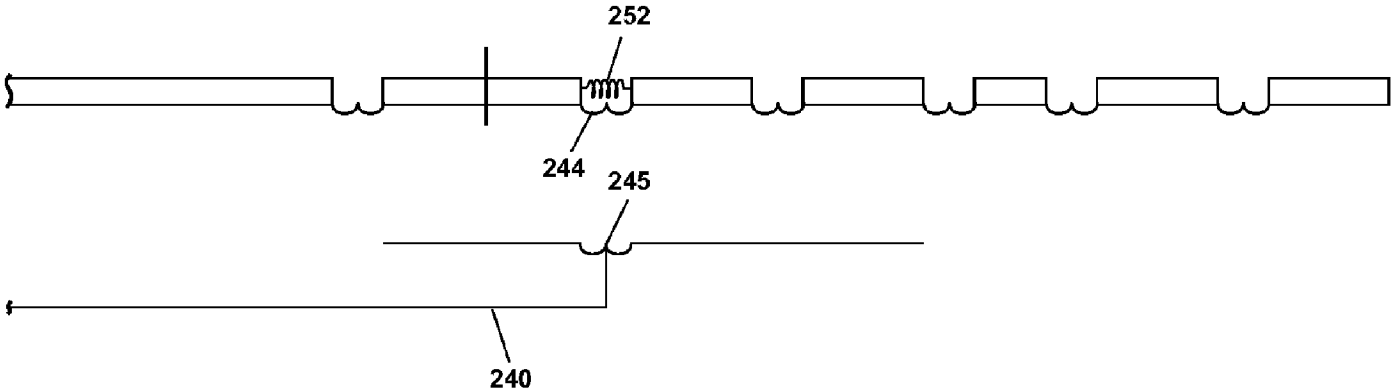
FIG. 17*a* is a schematic and electrical view of one embodiment of the dipole for the second band.
Figure 17B:
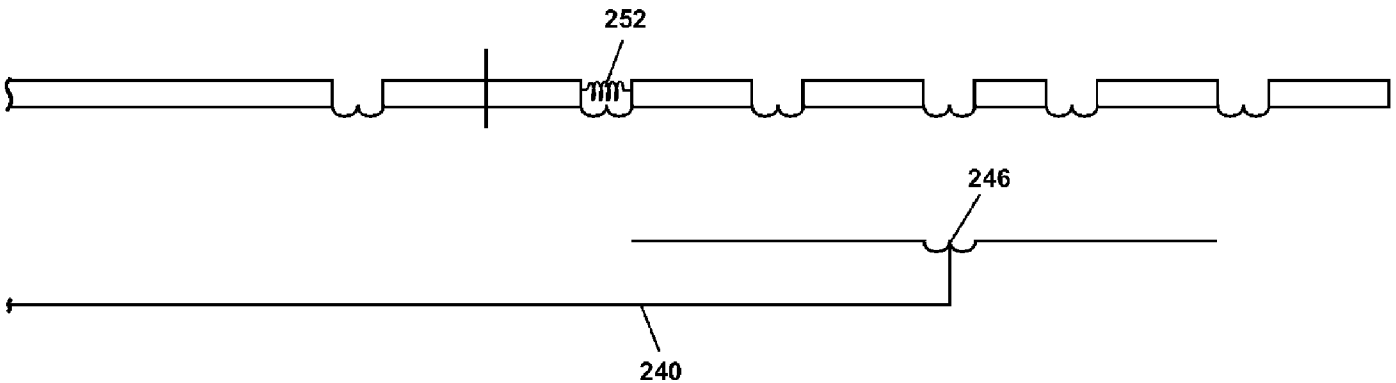
FIG. 17*b* is a schematic and electrical view of a second embodiment of the dipole for the second band.

The relatively mid range second frequency band can be resonant in a dipole that spans the junction 94, as shown in FIG. 17A, or in a dipole wholly located in the top section 182, as shown in FIG. 17B. In the first alternative, the dipole radiator is defined by the junction or dipole connector 94 on the one hand, and the conductive sleeves 224 and 226 on the other hand, with the feed point being the feed point 245. In this case, the isolation circuit 256 is transparent in the second frequency band. In the second alternative, the dipole radiator is defined by the conductive sleeves 224 and 226 on the one hand, and the conductive sleeves 228 and 230 on the other hand, with the feed point being the feed point 246 at the junction of the first 240, second 248 and third 250 cables.

In either the dual dipole situation for the third band or the single dipole situation for the second band where the dipole is located entirely in the upper section assembly, it has been found that adding a resonant circuit 252 such as, for example, a capacitor and an inductor in series, electrically connected between the conductive cylinder 184 and the conductive sleeve 224 at the feed point 245 helps gain in both bands.

It has also been found that if the same values are used for the isolation circuits 256, 258, 260, and 262, interactions among the first cable 240 and the conductive sleeves 224, 226, 228, 230, and 232 generate current distribution problems in the first (low frequency) band. Rather than selecting values for each isolation circuit to resonate at the midrange of the first band (e.g., 56 MHz), a solution has been found in selecting values so that each isolation circuit will resonate at a graduated step within the first band. For example, isolation circuit 252 can be made to resonate at 70 MHz, isolation circuit 256 to resonate at 60 MHz, isolation circuit 258 to resonate at 50 MHz, and isolation circuit 260 to resonate at 40 MHz. All isolation circuits referred to herein can be as shown in FIG. 14 or they can be any effective equivalent circuit, such as coaxial stubs.

It will be apparent in the illustrated embodiment that while dipoles are provided to resonate at three frequency bands, only two ports are provided to carry signals from the antenna: connectors 34 and 36 in the base cover mount. Signals in the first band (relatively low frequency) will always be conducted through the connector 34 by way of the cable 110 that communicates with the dipole at the feed point 178. Signals in the third band (relatively high frequency) will always be conducted through the connector 36 by way of the cables 108 and 240 that communicate with the dual dipoles at the feed points 252 and 254. Signals in the second band (mid range frequency) will be communicated through either of the connectors 34, 36, depending upon the dipole chosen. Providing isolation circuits that turn on and off at given frequencies will enable the second band to be communicated through either connector 34 or 36.

A second embodiment of a multiband antenna 300 according to the invention is shown in FIGS. 18–24. The antenna 300 comprises a mount assembly 302 and a whip assembly 304. The mount assembly 302 comprises a base housing 306 with an annular mounting flange 308, a base connector 310, a spring plate 312, a barrel spring 314, and an upper spring holder 316. The base housing 306 in this embodiment is conventional, adapted to mount to a vehicle (not shown) by bolts through apertures in the annular mounting flange 308.

Figure 19:
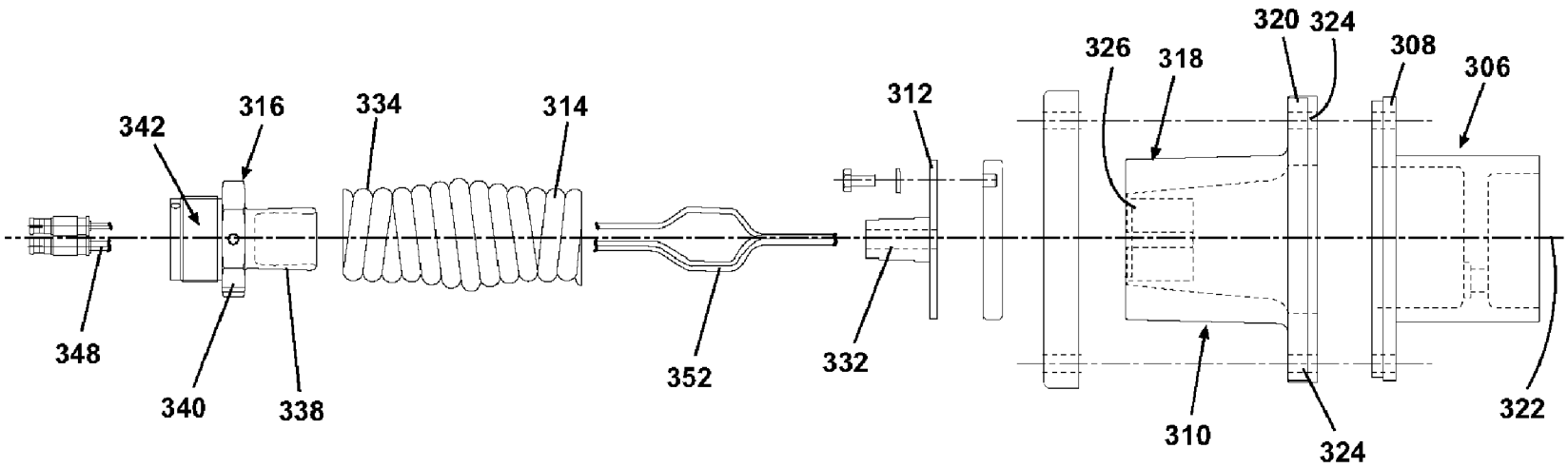
FIG. 19 is an exploded view of the mount assembly of FIG. 18.
Figure 20:
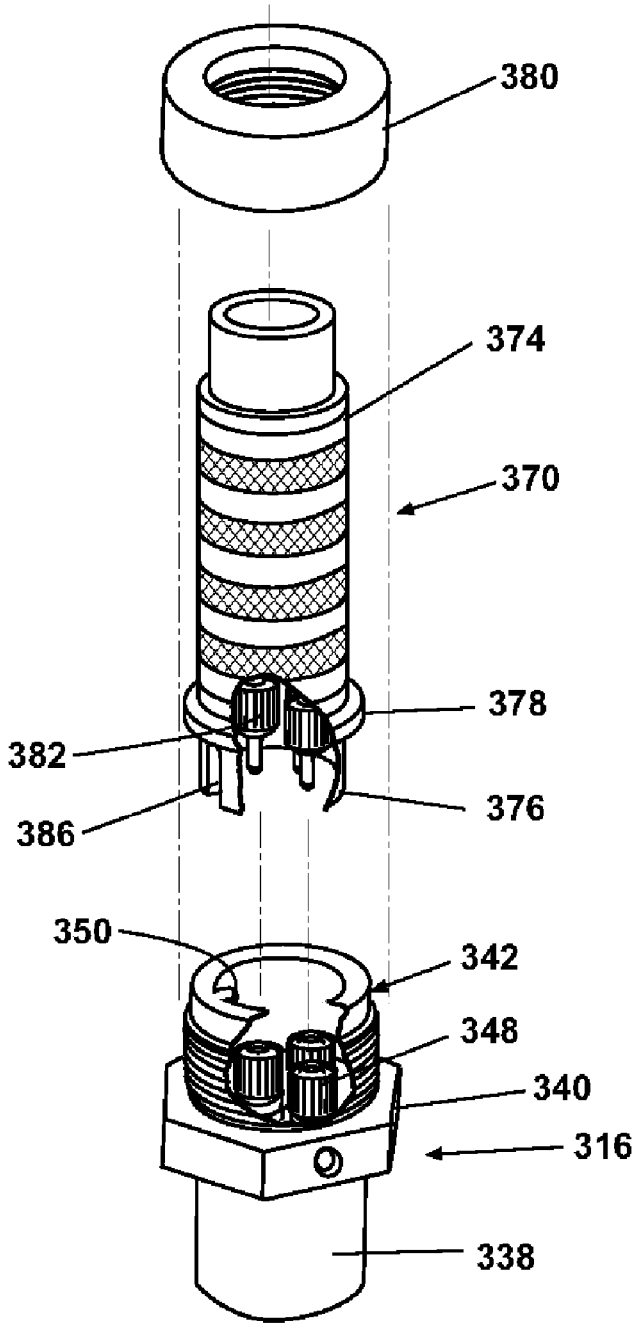
FIG. 20 is an isometric view with parts broken away of the male and female connectors between the mount assembly and the whip assembly of FIG. 18.
Figure 21:
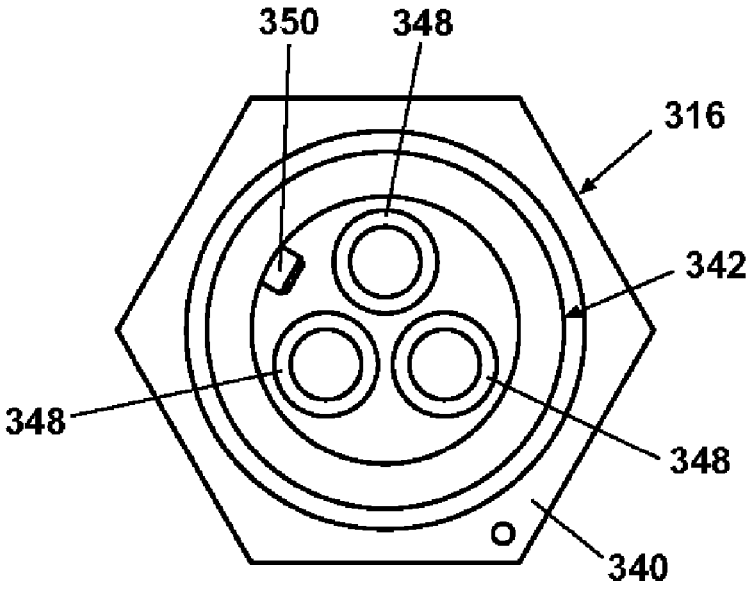
FIG. 21 is a bottom view of the mount assembly of FIG. 18.

Looking now at FIGS. 19–21, the base connector 310 comprises a hollow cylindrical body portion 318 that is covered at one end by a plate 320 centered on the longitudinal axis 322 of the body portion. The plate 320 has several apertures 324 at its periphery and the base connector 310 has three receptacles 326. The receptacles 326 are sealed against moisture.

The spring plate 312 is fixedly mounted to the spring 314 and bolted to the base connector plate 310, and has a central aperture 332 through which the connectors 326 are accessible. The interior of the spring 314 surrounds the central aperture 332.

At the upper end 334 of the spring 314 is the upper spring holder 316 nested within the spring 314 and comprising a lower body portion 338 that is received within the spring 314, a hex flange 340, and an upper body portion 342. The lower and upper body portions 338, 342 are hollow, separated by a wall at the hex flange 340. Three apertures extend through the wall, each aperture having a female coax connector 348 mounted therein. A key 350 in the form of a pin projects from the cylindrical wall of the upper body portion 342. The upper body portion 342 is externally threaded. A cable 352 is connected to each female coax connector 348 in the upper spring holder 316 and extends through the hollow lower portion 338, through the interior of the spring 314 to the spring plate 312 where each connector terminates in a female coax connector. Before the spring plate 312 is bolted to the base connector plate 310, each female coax connector is secured to a corresponding male coax connector 326 on the base connector plate 310. Leads connected to the male coax connectors 326 in the base connector plate 310 run through the base housing 306 to electrical circuitry.

Figure 18:
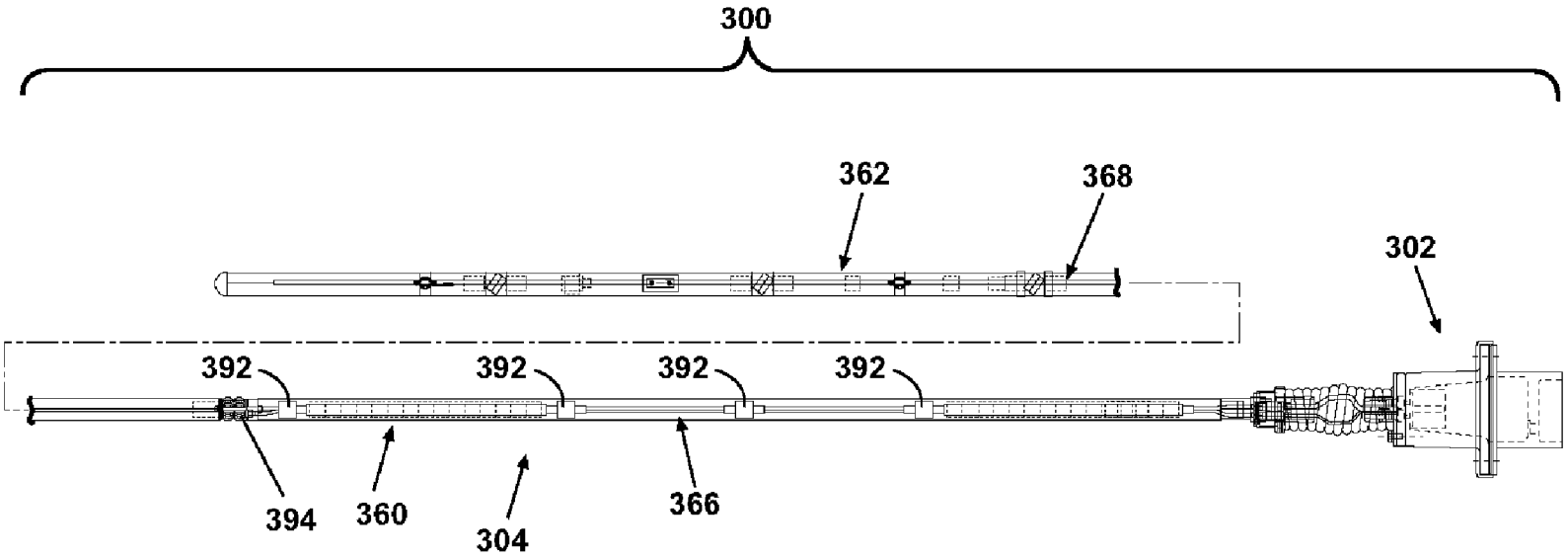
FIG. 18 is a cross sectional view of a second embodiment of a multiband antenna according to the invention.

Looking again at FIG. 18, the whip assembly 304 comprises a lower physical portion 360 and an upper physical portion 362. The lower 360 and upper 362 physical portions are integral, but they can be separable in a manner hereinafter described. The lower physical portion 360 carries a lower electrical element 366 and the upper physical portion 362 carries an upper electrical element 368. The lower electrical element 366 and upper electrical element 368 are together adapted to receive signals in the 30–175 MHz range. The upper electrical element comprises a set of dipoles that are adapted to receive frequencies in the 225–450 MHz range and 500–1000 MHz, respectively, through two separate coaxial transmission lines.

It will be understood that the physical structure of the electrical elements 366, 368 is similar to that in the first embodiment above, i.e., one or more transmission lines centered within a dielectric tube, wrapped with a conductive sleeve of copper or aluminum, all encased by a fiberglass housing. The lower electrical element 366 thus comprises a conductive sleeve 372 and three transmission lines 383, 384, and 385. The upper electrical element 368 comprises five conductive sleeves 396, 397, 398, 400, and 402, with one or two of the transmission lines 384, 385 centered therein. The transmission line 383 is a coaxial cable servicing the 30–175 MHz range. The transmission lines 384, 385 are also coaxial cables servicing the 225–450 MHz and 500–1000 MHz ranges, respectively. All of the transmission lines 383, 384, and 385 are centered within the conductive sleeves 372, 396, 397, 398, 400, and 402 by spacers 392.

At a lower end of the lower physical portion 360 is a male connector assembly 370. The male connector assembly 370 electrically connected to the conductive sleeve 372. The male connector assembly 370 comprises an elongated body portion 374 that is sized to be received by friction fit within one of the dielectric tube or the fiberglass housing, and a cylindrical portion 376 separated from the elongated body portion 374 by an annular flange 378. The cylindrical portion 376 is sized to fit within the upper body portion 342 of the upper spring holder 316 at the upper end of the spring 314. An internally threaded coupling nut 380 is received over the annular flange 378, and is sized to thread securely on to the externally threaded upper body portion 342 of the upper spring holder 316. Within the cylindrical portion 376 are three male coax connectors 382, one or more of which is connected to the coaxial transmission line 383 that runs through the elongated body portion 374 and into the conductive sleeve 372.

The external wall of the cylindrical portion 376 has a keyway 386 that extends from the annular flange 378 to the distal end of the cylindrical portion 376. The keyway 386 is adapted to interact with the key 350 on the upper body portion 342 of the upper spring holder 316, and is so located that the male and female coax connectors 348, 382 will be in registry when the cylindrical portion 376 is received within the upper body portion 342. It will be apparent that when the cylindrical portion 376 of the male connector assembly 370 is received within the upper body portion 342 of the upper spring holder 316, the coupling nut 380 can be threaded on to the external threads of the upper body of the upper spring holder to securely attach the two together. In this manner, the whip assembly 304 is secured to the mount assembly 302. The key 350 and keyway 386 enable the connection to be accomplished under any condition so that all electrical leads are properly aligned and connected.

The key 350 and keyway 386 can take many different forms. For example, the key can be a knob or protrusion of any shape extending from the cylindrical wall of the upper body portion 342, so long as it is complementary in shape to the keyway 386. Thus, for example, the key 350 and keyway 386 can take the form of a chordal wall on the upper body portion and a "D" shaped cylindrical portion 376, as in the first embodiment of the antenna.

Figure 22:
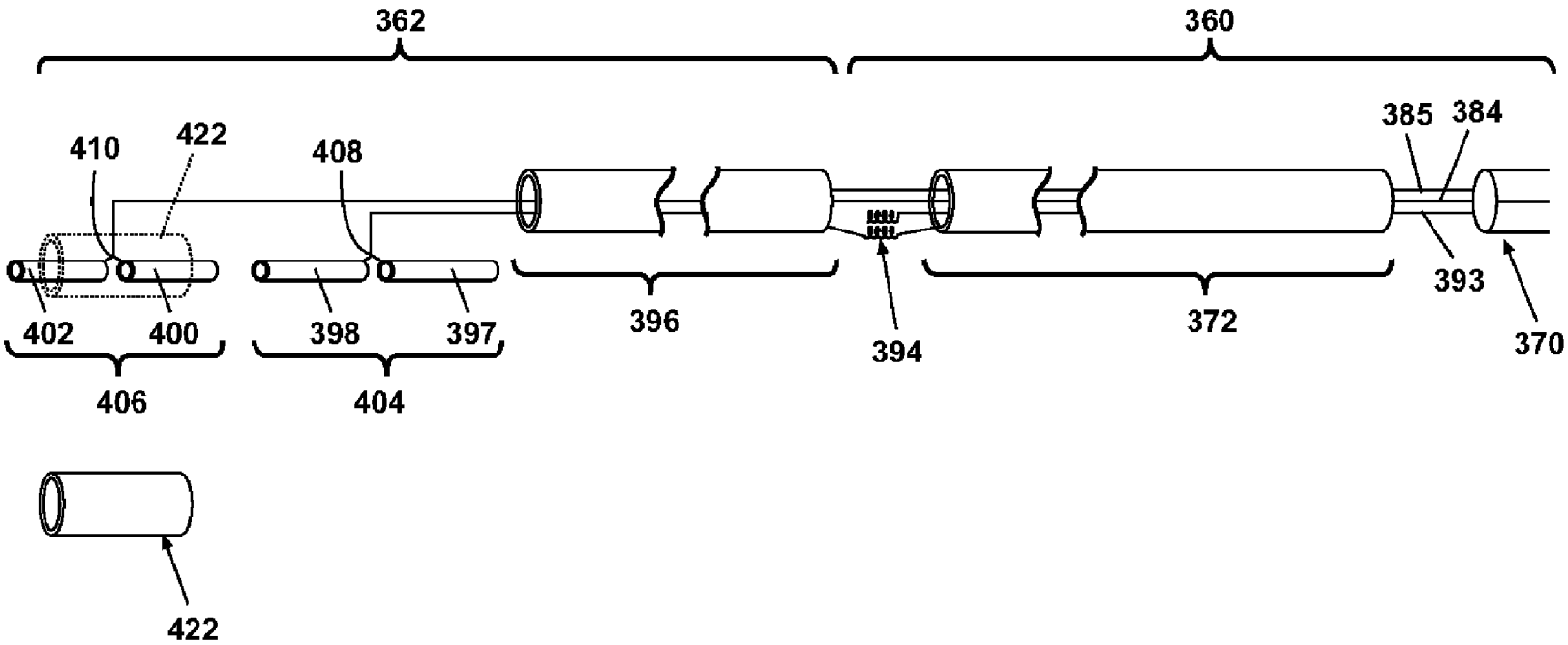
FIG. 22 is a schematic diagram of the electrical circuit of the antenna of FIG. 18.

Looking now more closely at FIG. 22, near the upper end of the lower physical portion 360 of the whip assembly 304 there is a transition from the lower electrical element 366 to the upper electrical element 368. The transition is from the balanced load of the lower electrical element 366 and upper electrical element 368 to the unbalanced impedance of the 30–175 MHz coaxial transmission line 383. This transition is accomplished by a balun 394, a transformer that effectively carries the load between the coaxial transmission line 383 and the lower 366 and upper 368 electrical elements. In the upper electrical element 368, further along the whip assembly 304, the conductive sleeves 397, 398, 400, and 402 form a series of dipole antennas 404, 406. Each dipole antenna 404, 406 comprises a pair of conductive sleeves electrically connected to each other at a feed point. The coaxial transmission lines 384, 385 extend concentrically within the dipole antennas to the respective feed points. At the balun 394, there is a connection between the transmission line 383 and the conductive sleeves 372, 396. The coaxial transmission line 384 feeds the lower and upper electrical elements in the frequency range 30–175 MHz. The dipole antennas 404, 406 are tuned to resonate in the frequency ranges of 225–450 MHz and 500–1000 MHz, respectively.

Figure 23:
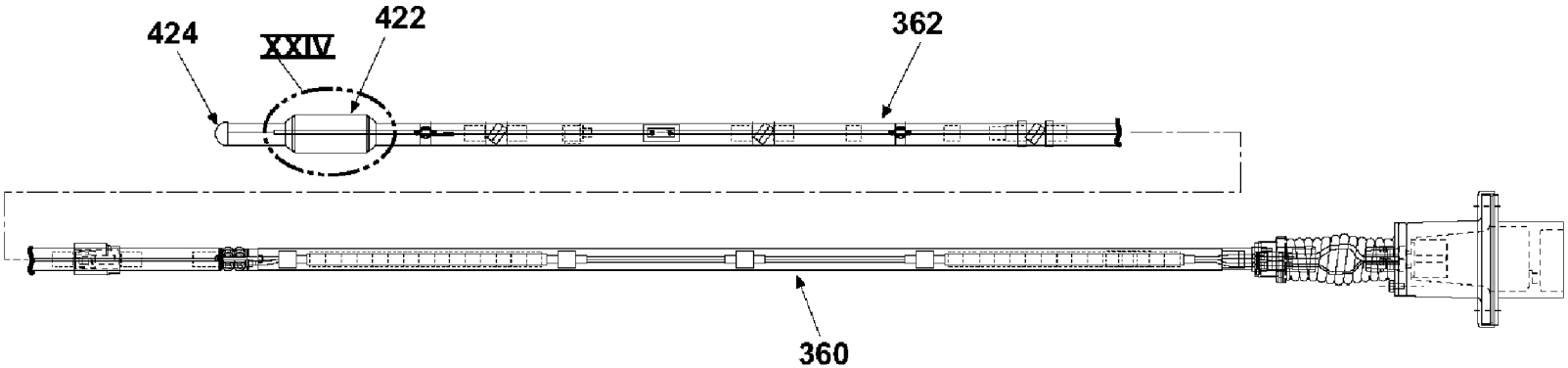
FIG. 23 is a cross sectional view of a third embodiment of a multiband antenna according to the invention.
Figure 24:
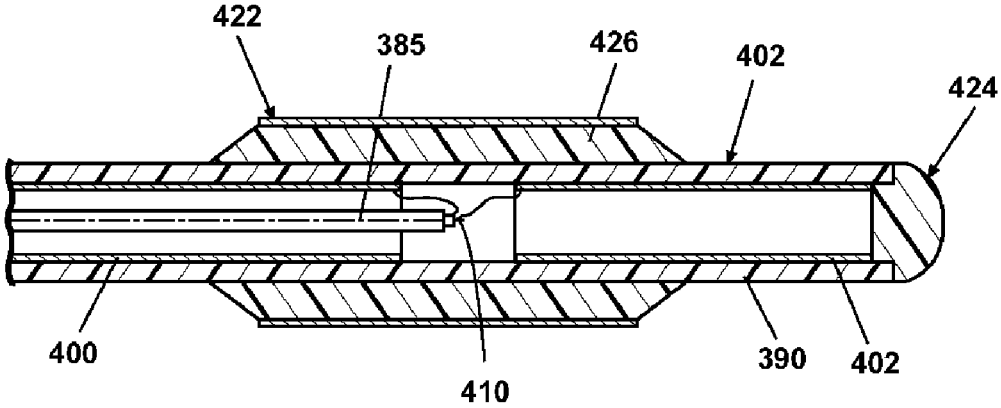
FIG. 24 is an enlarged cross sectional view of the area numbered XXIV in FIG. 23.

Looking now at FIGS. 22–24, a modification of the second embodiment of a multiband antenna according to the invention will effectively receive signals in all three separate frequency bands, including a broadband frequency range of 500–2500 MHz. In this modification, signals in each frequency range are channeled through one of the three ports in the connector between the whip assembly and the mount assembly, as before. The first frequency range at 30–175 MHz is received by the lower electrical element 366 and upper electrical elements 368. The second frequency range at 225–450 MHz is received by the single dipole 404 of the upper electrical element 368. The broadband high frequency range at 500–2500 MHz is received by what is effectively an open sleeve dipole 422 on the upper dipole antenna 406 near the upper end 424 of the whip assembly 304. This is effectively accomplished by providing a metal sleeve 425 on the outside of the fiberglass sleeve 390 and a dielectric spacer 426 of the whip assembly 304 at the feed point of the top dipole 406 of the upper electrical element 368.

It may be necessary for transportation and storage purposes to enable the antenna 300 to be broken down further. If that is needed, a break such as that described above for the first embodiment can be provided between the lower physical portion 360 and the upper physical portion 362. The break will be keyed as described above to ensure alignment of the two transmission lines 384385 of the upper electrical element 368.

While the invention has been specifically described in connection with certain specific embodiments thereof, it is to be understood that this is by way of illustration and not of limitation, and the scope of the appended claims should be construed as broadly as the prior art will permit.

What is claimed is:

1. An antenna for receiving or transmitting broadband, high frequency signals comprising a dipole antenna element encased within a dielectric housing, and a conductive sleeve provided over the dielectric housing at the feed point of the dipole antenna element.

2. The antenna of claim 1 wherein the dipole element comprises coaxial conductive tubes.

3. The antenna of claim 2 wherein the feed point is between the conductive tubes.

4. The antenna of claim 1 wherein a dielectric element is disposed between the conductive sleeve and the dielectric housing.

5. A multiband antenna incorporating the antenna of claim 1.

6. A mobile antenna for mounting to a vehicle, incorporating the antenna of claim 1.

7. The antenna of claim 1 wherein the high frequency signals are within a range of 500–2500 MHz.

* * * * *